US009728914B2

(12) United States Patent
Yoshino et al.

(10) Patent No.: US 9,728,914 B2
(45) Date of Patent: Aug. 8, 2017

(54) CONNECTION DEVICE AND RECEPTION DEVICE

(71) Applicant: Sony Corporation, Tokyo (JP)

(72) Inventors: Yoshitaka Yoshino, Tokyo (JP); Satoru Tsuboi, Kanagawa (JP); Tomomichi Murakami, Tokyo (JP); Makoto Makishima, Saitama (JP)

(73) Assignee: Sony Semiconductor Solutions Corporation, Kanagawa (JP)

( * ) Notice: Subject to any disclaimer, the term of this patent is extended or adjusted under 35 U.S.C. 154(b) by 0 days.

(21) Appl. No.: 15/036,750

(22) PCT Filed: Nov. 13, 2014

(86) PCT No.: PCT/JP2014/005700
§ 371 (c)(1),
(2) Date: May 13, 2016

(87) PCT Pub. No.: WO2015/075910
PCT Pub. Date: May 28, 2015

(65) Prior Publication Data

US 2016/0276788 A1 Sep. 22, 2016

(30) Foreign Application Priority Data

Nov. 22, 2013 (JP) ..... 2013-242295

(51) Int. Cl.
*H01R 24/58* (2011.01)
*H01R 24/50* (2011.01)
*H01R 107/00* (2006.01)

(52) U.S. Cl.
CPC ..... *H01R 24/58* (2013.01); *H01R 24/50* (2013.01); *H01R 2107/00* (2013.01)

(58) Field of Classification Search
CPC ..... H01R 24/58; H01R 2103/00; H01R 2105/00; H01R 2107/00; H01R 2201/12
(Continued)

(56) References Cited

U.S. PATENT DOCUMENTS 6,595,804 B2 * 7/2003 Nagata ..... H01R 24/58 439/668
6,704,956 B2 * 3/2004 Riley ..... A61G 7/05 5/503.1
(Continued)

FOREIGN PATENT DOCUMENTS

CN 201015156 Y 1/2008
JP 43-002436 Y1 2/1968
(Continued)

*Primary Examiner* — Abdullah Riyami
*Assistant Examiner* — Vladimir Imas
(74) *Attorney, Agent, or Firm* — Wolf, Greenfield & Sacks, P.C.

(57) ABSTRACT

A connection device includes a rod-shaped electrode, a plurality of cylindrical electrodes through which the rod-shaped electrode passes, the plurality of cylindrical electrodes being sequentially exposed on a surface in order from a front end side of the rod-shaped electrode, an insulation section configured to insulate the rod-shaped electrode and the plurality of cylindrical electrodes from each other, and a plurality of connection terminals electrically connected to the rod-shaped electrode and the plurality of cylindrical electrodes in a vicinity of a rear end of the rod-shaped electrode, the plurality of connection terminals being protruded from a rear side.

12 Claims, 12 Drawing Sheets

(58) Field of Classification Search
USPC ..... 439/669, 668, 675
See application file for complete search history.

(56) References Cited

U.S. PATENT DOCUMENTS

| | | | | |
|---|---|---|---|---|
| 7,008,269 | B2 * | 3/2006 | Riley | A61G 7/05 439/668 |
| 7,309,262 | B2 * | 12/2007 | Zart | H01R 13/405 439/736 |
| 7,316,588 | B1 * | 1/2008 | Rogers | H01R 23/26 439/668 |
| 7,316,589 | B1 * | 1/2008 | Rogers | H01R 23/26 439/668 |
| 7,322,858 | B1 * | 1/2008 | Rogers | H01R 24/58 439/668 |
| 7,407,416 | B1 * | 8/2008 | Rogers | H01R 24/58 439/669 |
| 7,445,516 | B2 * | 11/2008 | Chung | H01R 13/6658 439/654 |
| 7,611,367 | B2 * | 11/2009 | Lee | H01R 24/58 439/218 |
| 7,670,192 | B2 * | 3/2010 | Wu | H01R 24/58 439/447 |
| 7,727,029 | B2 * | 6/2010 | Bolin | G02B 6/3895 439/660 |
| 7,789,697 | B2 * | 9/2010 | Fiennes | H01R 13/7031 439/188 |
| 7,824,229 | B1 * | 11/2010 | Yang | H01R 13/42 439/669 |
| 7,892,039 | B2 * | 2/2011 | Feeney | H01R 24/58 439/669 |
| 7,901,253 | B2 * | 3/2011 | Yudate | H01R 24/58 439/63 |
| 7,950,967 | B2 * | 5/2011 | Stiehl | H01R 24/58 439/669 |
| 8,206,181 | B2 * | 6/2012 | Steijner | H01R 24/58 439/668 |
| 8,249,672 | B2 * | 8/2012 | Chen | H01R 24/30 439/626 |
| 8,435,081 | B2 * | 5/2013 | Aase | H01B 7/223 439/669 |
| 8,467,828 | B2 * | 6/2013 | Johnson | H01R 13/703 455/556.1 |
| 8,628,348 | B2 * | 1/2014 | Ries | H01R 43/24 439/376 |
| 8,998,649 | B2 * | 4/2015 | Lam | H01R 24/58 439/669 |
| 9,103,866 | B2 * | 8/2015 | Mehrabi | G01R 31/04 |
| 9,124,048 | B2 * | 9/2015 | Golko | H01R 13/052 |
| 9,142,925 | B2 * | 9/2015 | Golko | H01R 13/642 |
| 9,301,045 | B2 * | 3/2016 | Johnson | H01R 13/703 |
| 9,362,660 | B2 * | 6/2016 | Ries | A61N 1/3752 |
| 2002/0052148 | A1 * | 5/2002 | Nagata | H01R 24/58 439/668 |
| 2004/0242076 | A1 * | 12/2004 | Nakai | H01R 24/40 439/668 |
| 2006/0089054 | A1 * | 4/2006 | Woo | H01R 24/58 439/668 |
| 2010/0009574 | A1 | 1/2010 | Shi et al. | |
| 2013/0307184 | A1 * | 11/2013 | Ries | A61N 1/3754 264/272.14 |

FOREIGN PATENT DOCUMENTS

| | | | |
|---|---|---|---|
| JP | 04-035193 | A | 2/1992 |
| JP | 04-181663 | A | 6/1992 |
| JP | 05-087855 | U | 11/1993 |
| JP | 09-161896 | A | 6/1997 |
| JP | 10-199631 | A | 7/1998 |
| JP | 2000-340309 | A | 12/2000 |
| JP | 2011-172125 | A | 9/2011 |
| WO | WO 2008/060470 | A2 | 5/2008 |
| WO | WO 2010/141147 | A1 | 12/2010 |

* cited by examiner

CONNECTION DEVICE AND RECEPTION DEVICE

TECHNICAL FIELD

The present disclosure relates to a connection device and a reception device to which the connection device is connected, which can be applied to a round plug.

BACKGROUND ART

As a plug that is used in a portable music player, a plurality of standardized multi-pole plugs having two to four poles are provided in the related art. As types of the plugs, there are a standard type (a terminal having a diameter of 6.3 mm), a small type (referred to as a mini-plug and a terminal having a diameter of 3.5 mm), and an ultra-small type (referred to as a micro plug and a terminal having a diameter of 2.5 mm). Furthermore, the portable music player in recent years has a variety of functions and a plug with many pole numbers is also used since it is necessary to perform noise cancelling, to have a multifunctional remote control function, or the like.

The standard of the plug is established by Japanese Industrial Standards, Japan Electronics And Information Technology Industries Association (JEITA) Standard, and the like. A core rod electrode and a plurality of cylindrical electrodes extend and are exposed to a rear end side (an opposite end to a front end side that is inserted into a jack) of the plug. That is, in order to directly solder a wiring material to the electrode, an extension section of the electrode has a bamboo shoot structure.

For example, an antenna device that is configured of a plug having three electrodes for an antenna cable, an earphone cable, and an audio signal is disclosed in Patent Literature 1. In order to provide a relay section as a high-frequency signal blocking section between a cable for transmitting a stereo signal and the plug, the antenna device is configured such that a wiring substrate on which the relay section is mounted is connected to the plug. That is, a conductive pattern on the substrate and the electrode are connected to each other by cutting the substrate in a bamboo shoot shape.

CITATION LIST

Patent Literature

Patent Literature 1: JP 2011-172125A

SUMMARY OF INVENTION

Technical Problem

In the connection method described above, there are problems that an operation takes much time and strength of a connection section also decreases. Furthermore, the portion to which the substrate or a wiring material is connected has the bamboo shoot shape, a plurality of electrodes are laminated, and thereby it becomes very poor for isolation of each terminal in a high-frequency manner and transmission characteristics. Furthermore, there is a problem that a shape of the plug increases for provision of the connection section having the bamboo shoot shape.

Accordingly, an object of the present disclosure is to provide a connection device that enables easy and robust connection with a wiring substrate and that is preferable in isolation in a high-frequency manner and in transmission characteristics, and, further, to provide a connection device that is smaller in size and a reception device to which the connection device is connected.

Solution to Problem

The present disclosure is a connection device, including: a rod-shaped electrode; a plurality of cylindrical electrodes through which the rod-shaped electrode passes, the plurality of cylindrical electrodes being sequentially exposed on a surface in order from a front end side of the rod-shaped electrode; an insulation section configured to insulate the rod-shaped electrode and the plurality of cylindrical electrodes from each other; and a plurality of connection terminals electrically connected to the rod-shaped electrode and the plurality of cylindrical electrodes in a vicinity of a rear end of the rod-shaped electrode, the plurality of connection terminals being protruded from a rear side.

The present disclosure is a reception device to which such a connection device can be connected.

Advantageous Effects of Invention

According to at least one embodiment, since the connection terminal is protruded in the vicinity of the rear end of the rod-shaped electrode, and the connection between the connection terminal and the substrate is facilitated. Furthermore, since all electrodes are not laminated in concentric circles with each other, the isolation in a high-frequency manner and the transmission characteristics may be favorably performed. Furthermore, since the electrode portion on the rear side may be omitted, the shape may be reduced. Moreover, effects of the present disclosure are not necessarily limited to the effects described above and may be the effects that are described in the present disclosure.

DESCRIPTION OF EMBODIMENT(S)

Embodiments described below is preferred embodiments of the present disclosure and various technically preferable limitations are given thereto. However, in the following description, the scope of the present disclosure is limited to the embodiment, without intent to limit the present disclosure, particularly.

The following description is made in the order as below.

1. 4-Pole Plug of Related Art
2. First Embodiment
3. Second Embodiment
4. Modification Examples

1. 4-Pole Plug of Related Art

Figure 1:
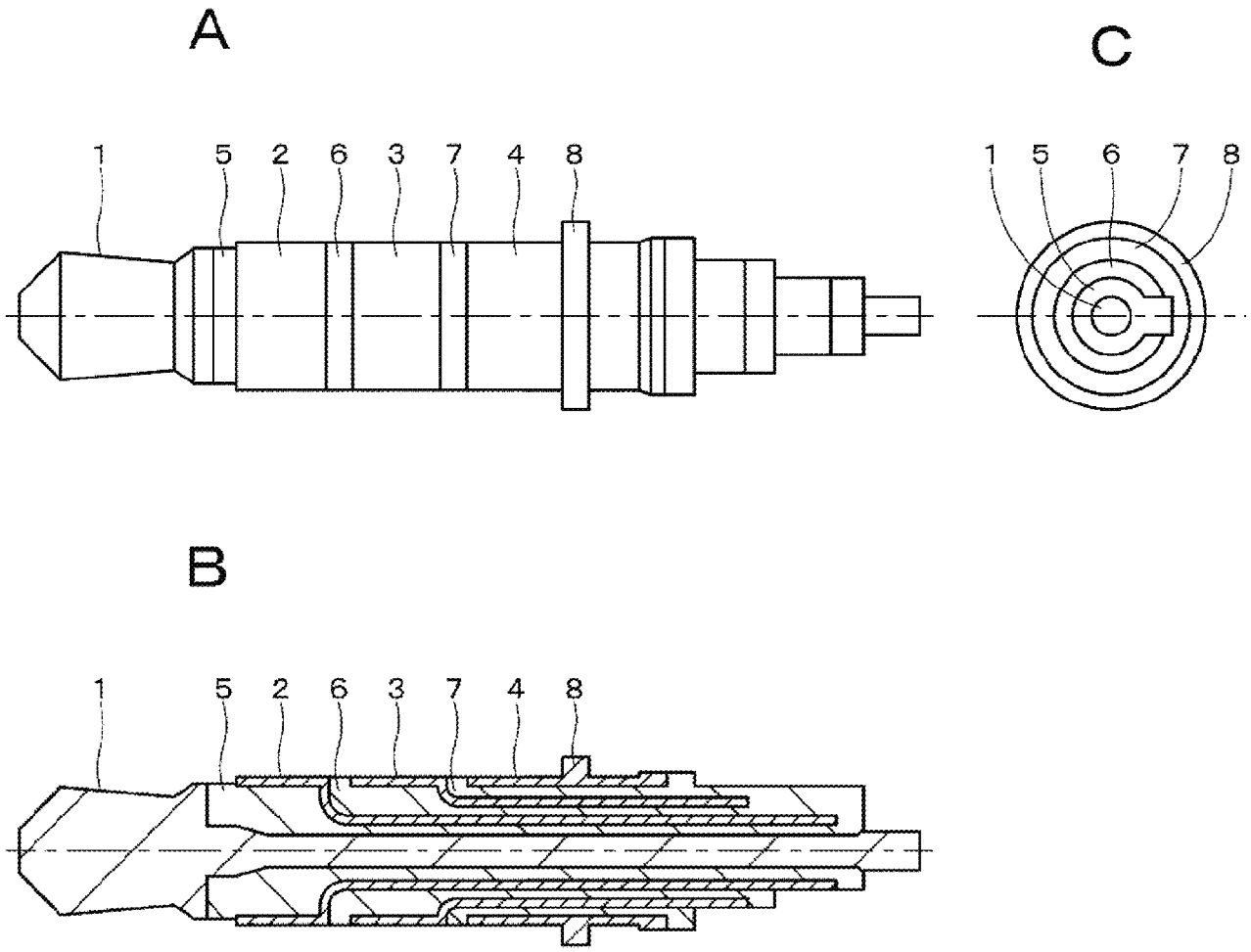
FIG. 1 is an elevational view, a cross-sectional view, and a side view of a 4-pole plug of the related art.

In order to facilitate understanding of description of the present disclosure, a 4-pole plug of the related art is described with reference to FIGS. 1A to 1C. FIG. 1A is an elevational view of the 4-pole plug, FIG. 1B is a cross-sectional view of a central line of FIG. 1A, and FIG. 1C is a side view. As illustrated in FIGS. 1A to 1C, a front end portion of a rod-shaped electrode (hereinafter, appropriately referred to as a tip) 1 as a first electrode is exposed and a plurality of cylindrical electrodes are sequentially exposed on a surface in order from the front end side of the tip 1.

That is, a ring 2 as a second electrode, a ring 3 as a third electrode, and a sleeve 4 as a fourth electrode are provided in this order from the front end side (an exposed section of the tip 1). An insulation section (a collar) 5 for insulating the tip 1 and the ring 2 from each other, an insulation section (collar) 6 for insulating the ring 2 and the ring 3 from each other, and an insulation section (collar) 7 for insulating the ring 3 and the sleeve 4 from each other are provided. The collars 5, 6, and 7 are made of a resin, for example, a resin of polyoxymethylene (POM) system. The plug is produced by insert molding.

A flange section 8 is formed in the sleeve 4. The sleeve 4 extends to the rear side of the flange section 8. The tip 1, the ring 2, and the ring 3 similarly extend to the rear side of the flange section 8. Each of cylindrical electrodes is laminated so as to have a concentric cross section about the tip 1 as a core. Insulation member integrally formed with the collars 5, 6, and 7 described above is interposed between cylindrical surfaces of the electrodes and then the electrodes are insulated from each other.

That is, on the rear side of the flange section 8, similar to the front side thereof, the tip 1 and the ring 2 are insulated by the collar 5, the ring 2 and the ring 3 are insulated by the collar 6, and the ring 3 and the sleeve 4 are insulated by the collar 7. In order to solder each electrode and a wiring material, on the rear side of the flange section 8, a diameter of each electrode sequentially narrows (bamboo shoot shape).

Each dimension on a side in which the 4-pole plug described above is inserted into the jack is specified as the standard, based on a reference surface (front side end surface of the flange section 8). When inserted into the jack of which the dimensions are specified as the standard, the electrical connection of each electrode is ensured.

In the plug of the related art described above, when connecting a cable, the cable is soldered to each electrode having a sequentially narrowing shape (bamboo shoot shape). Furthermore, when connecting a conductive pattern of a wiring substrate to the plug, a notch conforming to the shape of the rear side is formed in the wiring substrate and each electrode and the conductive pattern are soldered to each other. The connection method takes much time and it is not suitable for mass production, and further, a mechanical strength is insufficient and there is a concern of disconnection.

Furthermore, when transmitting a high-frequency signal through the plug, since electrodes are laminated to each other through the insulation material, there are problems that a capacitive component is formed between electrodes and isolation of the high-frequency signal is insufficient, and then the loss is increased. Specifically, in a case of the 4-pole plug described above, there is a problem that two high-frequency signal transmission paths are unlikely to be formed using a pair of electrodes.

Furthermore, since the connection section from which four electrodes are exposed is provided on the rear side of the flange section, there are problems that a length of a portion for connection is increased and the shape of the plug is relatively increased. The present disclosure is made to solve these problems.

2. First Embodiment

Figure 2:
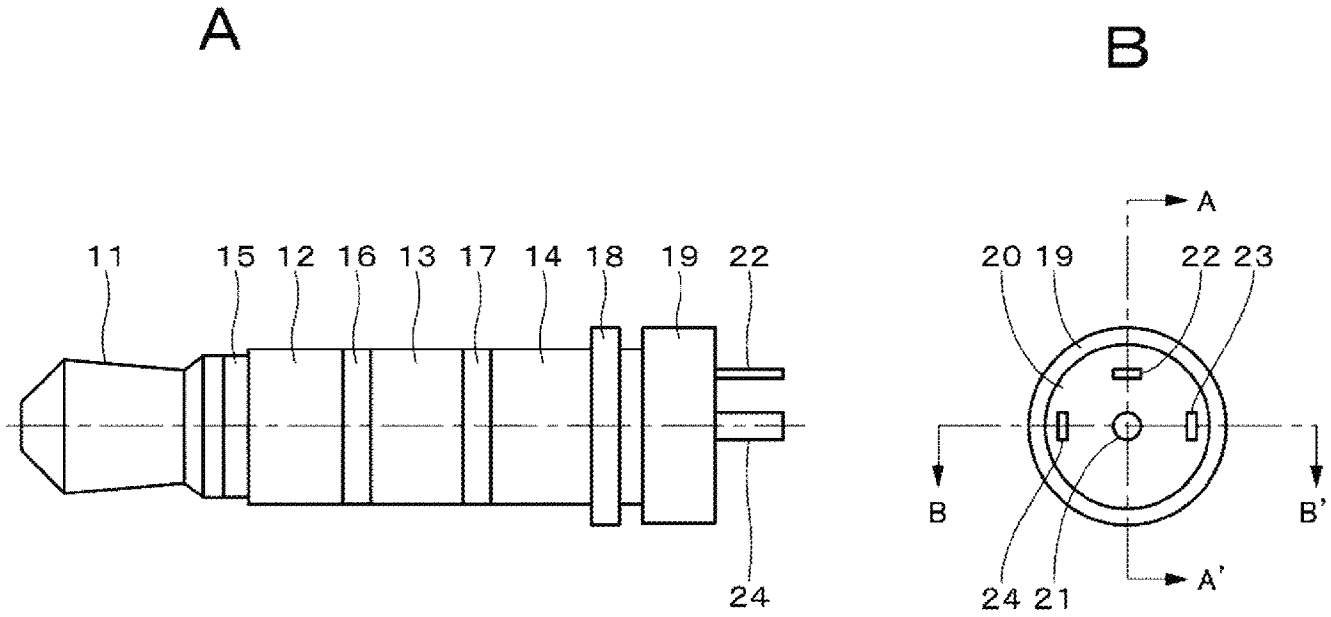
FIG. 2 is an elevational view and a side view of a first embodiment of the present disclosure.
Figure 3:
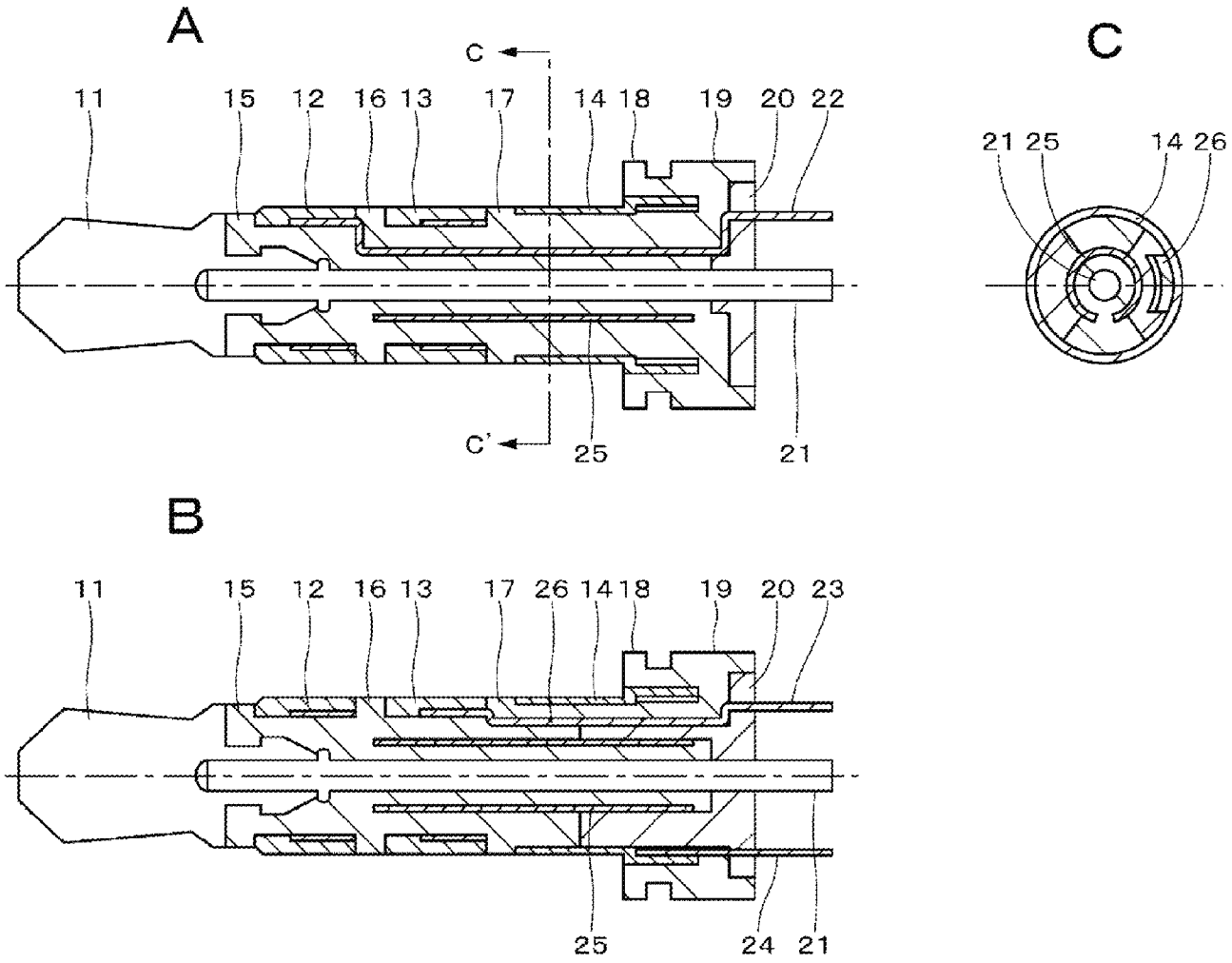
FIG. 3 is a cross-sectional view that is taken along lines A-A', B-B', and C-C' of the first embodiment of the present disclosure.

Hereinafter, the first embodiment in which the present disclosure is applied to a 4-pole plug will be described in detail. FIG. 2A is an elevational view of the first embodiment and FIG. 2B is a side view of the first embodiment. Furthermore, FIG. 3A is a cross-sectional view that is taken along line A-A' in FIG. 2B, FIG. 3B is a cross-sectional view that is taken along line B-B' in FIG. 2B, and FIG. 3C is a cross-sectional view that is taken along line C-C' in FIG. 3A.

Similar to the 4-pole plug of the related art described above, a rod-shaped tip 11 as a first electrode, a cylindrical ring 12 as a second electrode, a cylindrical ring 13 as a third electrode, and a cylindrical sleeve 14 as a fourth electrode are provided in this order from a leading end on the side that is inserted into the jack.

An insulation section (collar) 15 for insulating the tip 11 and the ring 12 from each other, an insulation section (collar) 16 for insulating the ring 12 and the ring 13 from each other, and an insulation section (collar) 17 for insulating the ring 13 and the sleeve 14 from each other are provided. The collars 15, 16, and 17 are made of a resin, for example, a resin of polyoxymethylene (POM) system. As an example, the plug is produced by insert molding.

A cylindrical base section 19 having a flange section 18 is provided on the rear side of the sleeve 14. The base section 19 is integrally molded with the collars 15, 16, and 17 in a resin. A circular concave section is formed on an end surface of the base section 19 and a rear collar 20 made of a resin is disposed in the concave section. Moreover, the rear collar 20 is formed integrally or separately with or from the collars 15, 16, and 17. As described below, the wiring substrate is mounted on the rear collar 20.

If each dimension of the 4-pole plug described above on the side of inserting into the jack is specified as the standard based on a reference surface (the end surface of the flange section 18 on the front side) and the 4-pole plug is inserted into the jack of which the dimension is specified as the standard, the electrical connection of each electrode is secured.

A pin 21, a contact 22, a contact 23, and a contact 24 are protruded rear outward from the rear collar 20. One end of the pin 21 is fitted to a hole formed at a center of the tip 11 and the other end protrudes from the center of the rear collar 20. For the contact 22, the contact 23, and the contact 24, for example, metal having elasticity such as phosphor bronze may be used.

A substantially cylindrical extension electrode 25 having a diameter smaller than that of the ring 12 is fixed to the ring 12. The extension electrode 25 extends rearward and the pin 21 passes through the center thereof. The other end side of the extension electrode 25 is processed into a thin plate shape and protrudes from a predetermined position of the rear collar 20 as the contact 22. It is possible to have good isolation in a high-frequency manner between the pin 21 and the electrodes outside the extension electrode 25 by providing the cylindrical extension electrode 25.

An extension electrode 26 having a circular cross section is fixed to the ring 13. The extension electrode 26 is disposed to overlap a part of a peripheral surface of the extension electrode 25 at a predetermined interval. The extension electrode 26 extends rearward. The other end side of the extension electrode 26 is processed into a thin plate shape and protrudes from a predetermined position of the rear collar 20 as the contact 23. The thin plate-shaped contact 24 is fixed to the sleeve 14 and the contact 24 protrudes from a predetermined position of the rear collar 20. As illustrated in FIG. 3C, intervals between the pin 21, the extension electrode 25, the extension electrode 26, and the sleeve 14 are substantially equal to each other in the cross-section direction.

As the standard for the signal assignment with respect to each 3.5 mm electrode of the 4-pole stereo mini plug of the related art, Open Mobile Terminal Platform (OMTP), Cellular Telephone Industry Association (CTIA), and the like are known.

The signal assignment of the OMTP standard is indicated below.

Tip 11: left channel (L)
Ring 12: right channel (R)
Ring 13: microphone
Sleeve 14: ground The signal assignment of the CTIA standard is indicated below.

Tip 11: left channel (L)
Ring 12: right channel (R)
Ring 13: ground
Sleeve 14: microphone When comparing the first embodiment of the present disclosure described above to the 4-pole plug of the related art illustrated in FIGS. 1A to 1C, the tip 11 passes through the center similar to the tip 1, but portions overlapping cylindrical electrodes of the ring 12, the ring 13, and the sleeve 14 are reduced. Furthermore, a pin shape is formed in the portion on which the wiring substrate is mounted. Furthermore, the ring 12 and the extension electrode 25 are formed so as to cover the tip 11. Furthermore, the contact 23 connected to the ring 13 and the contact 24 connected to the sleeve 14 are disposed in positions facing each other at 180 degrees on the rear collar 20. Furthermore, the intervals among the pin 21, the extension electrode 25, the extension electrode 26, and the sleeve 14 are substantially equal to each other in the cross-section direction. It is possible to have good isolation among the pin 21, the contact 22, the contact 23, and the contact 24 by the configuration.

Therefore, it is possible to form the high-frequency signal transmission path configured of the tip 11 and the ring 12, and the high-frequency signal transmission path configured of the ring 13 and the sleeve 14 by making the ring 12 and the sleeve 14 the ground in a high-frequency manner. The isolation of two high-frequency signal transmission paths is preferable and it is possible to reduce attenuation at high-frequency. Therefore, for example, it is possible to transmit two antenna signals by only using one 4-pole plug according to one embodiment of the present disclosure. Therefore, it is possible to realize having one jack where two jacks are necessary in the related art.

Moreover, the present disclosure is not limited to the example in which two high-frequency signal transmission paths are configured. For example, the present disclosure may be configured of one high-frequency signal transmission path and one stereo audio signal transmission path. In this case, the electrode (for example, microphone electrode) that is not used for the stereo audio signal transmission path of the related art is assigned for the high-frequency signal transmission and the electrode for the ground becomes a common ground.

Figure 4:
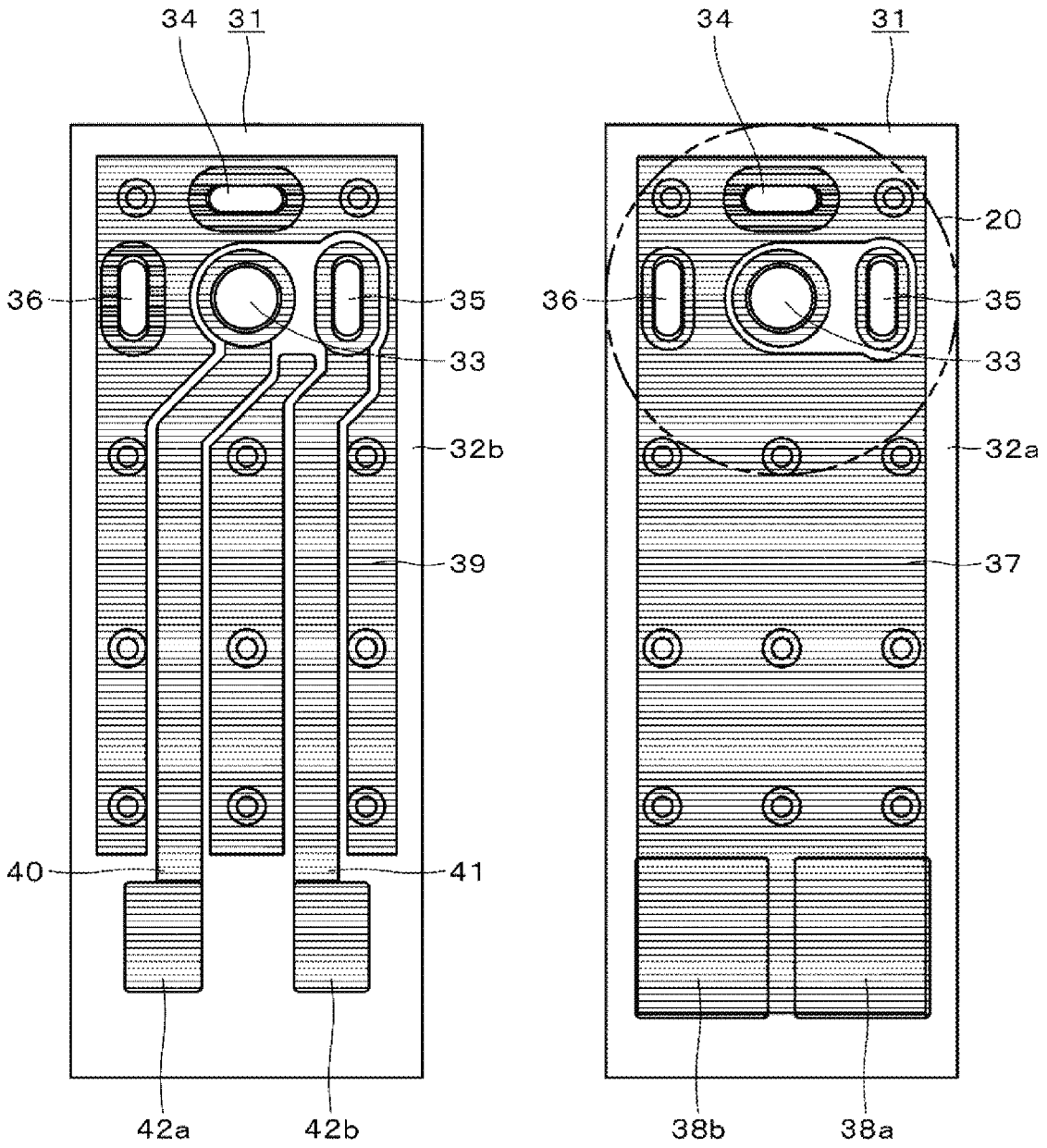
FIG. 4 is a view illustrating both surfaces of a wiring substrate in the first embodiment of the present disclosure.

The pin 21, the contact 22, the contact 23, and the contact 24 protruding from the rear collar 20 of the base section 19 are inserted into holes formed in a wiring substrate 31 illustrated in FIG. 4. The wiring substrate 31 has one surface 32*a* against which the rear collar 20 abuts as indicated by a two-dot chain line and another surface 32*b*. Moreover, in FIG. 4, the reason why lines are given is that it is easy to distinguish the conductive pattern formed in the wiring substrate 31.

As a substrate of the wiring substrate 31, a rigid substrate such as a glass-epoxy substrate, a flexible substrate, or a rigid flexible substrate may be used. A flexible material as the base material is used in the flexible substrate. The rigid flexible substrate is obtained by integrating a rigid material and a thin and flexible material. A type of the substrate is appropriately selected depending on an outer shape (straight or L shape) of the plug.

A hole 33 that is provided corresponding to the pin 21, a hole 34 that is provided corresponding to the contact 22, a hole 35 that is provided corresponding to the contact 23, and a hole 36 that is provided corresponding to the contact 24 are formed in the wiring substrate 31. The holes 33, 34, and 35 are configured of an eyelet, through-hole vias, and the like, and connect the conductive patterns formed on both sides. For example, the soldering between the pin 21 and the contacts 22, 23, and 24 of the plug, and the conductive patterns on the wiring substrate 31 may be performed from the side of the other surface 32*b* that does not come into contact with the rear collar 20. Therefore, the soldering is easily performed.

The conductive patterns formed on the one surface and the other surface of the wiring substrate 31 and/or the elements that are mounted on the conductive patterns, and the like may be appropriately selected depending on the purpose of the use. For example, as described above, when forming two high-frequency signal transmission paths, the ring 12 and the sleeve 14 are grounded in a high-frequency manner. The contact 22 and the contact 24 connected thereto are inserted into the hole 34 and the hole 36, respectively. The hole 34 and the hole 36 are connected to a common ground conductive pattern 37 in the one surface 32*a* of the wiring substrate 31.

For example, if two coaxial cables are used as two high-frequency signal transmission paths, the ground conductive pattern 37 is extended and connection sections 38*a* and 38*b* of a shield of each coaxial cable are provided on the ground conductive pattern 37. Interface adjustment is performed between the 4-pole plug and the coaxial cable. Note that by configuring the two coaxial cables to have a predetermined length, shielding wires thereof can be used to constitute two antennas.

A ground conductive pattern 39 connecting the hole 34 and the hole 36 is formed in the other surface 32*b* of the wiring substrate 31. A conductive pattern 40 connected to the hole 33 and a conductive pattern 41 connected to the hole 35 extend in parallel, respectively. A core wire connection section 42*a* of the coaxial cable is formed at an extension end of the conductive pattern 40 and a core wire connection section 42*b* of the coaxial cable is formed at an extension end of the conductive pattern 41.

Figure 5:
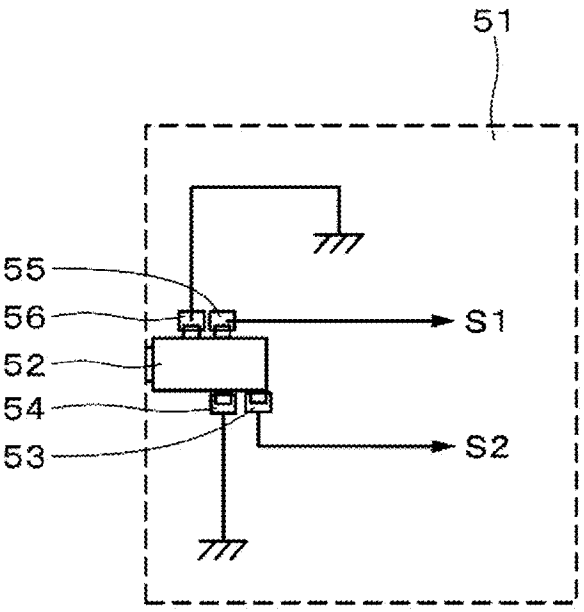
FIG. 5 is a schematic diagram that is used for illustrating a connection form of the first embodiment of the present disclosure.
Figure 5:
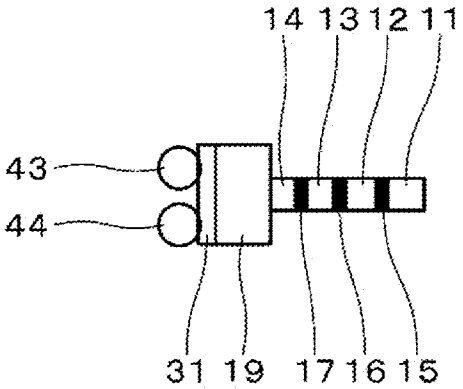

As illustrated in FIG. 5, the 4-pole plug according to the present disclosure described above is inserted into a 4-pole jack 52 of an electronic device (a television tuner, a portable device, and the like) 51. A 4-pole jack that conforms to conventional standards can be used as the 4-pole jack 52. For example, coaxial cables 43 and 44 with shielding wires that function as antennas are connected to the wiring substrate 31.

Electrodes that come in contact with the electrodes of the 4-pole plug are provided inside the 4-pole jack 52. One high-frequency signal S2 is output from a connection terminal 53 connected to the electrode in contact with the tip 11 and from a connection terminal 54 connected to the electrode in contact with the ring 12. Another high-frequency signal S1 is output from a connection terminal 55 connected to the electrode in contact with the ring 13 and from a connection terminal 56 connected to the electrode in contact with the sleeve 14. The high-frequency signal S1 and the high-frequency signal S2 are supplied to the tuner inside the electronic device 51. For example, when the television tuner is configured of a diversity reception system, two antenna signals can be received by just providing a single jack 52.

Figure 6:
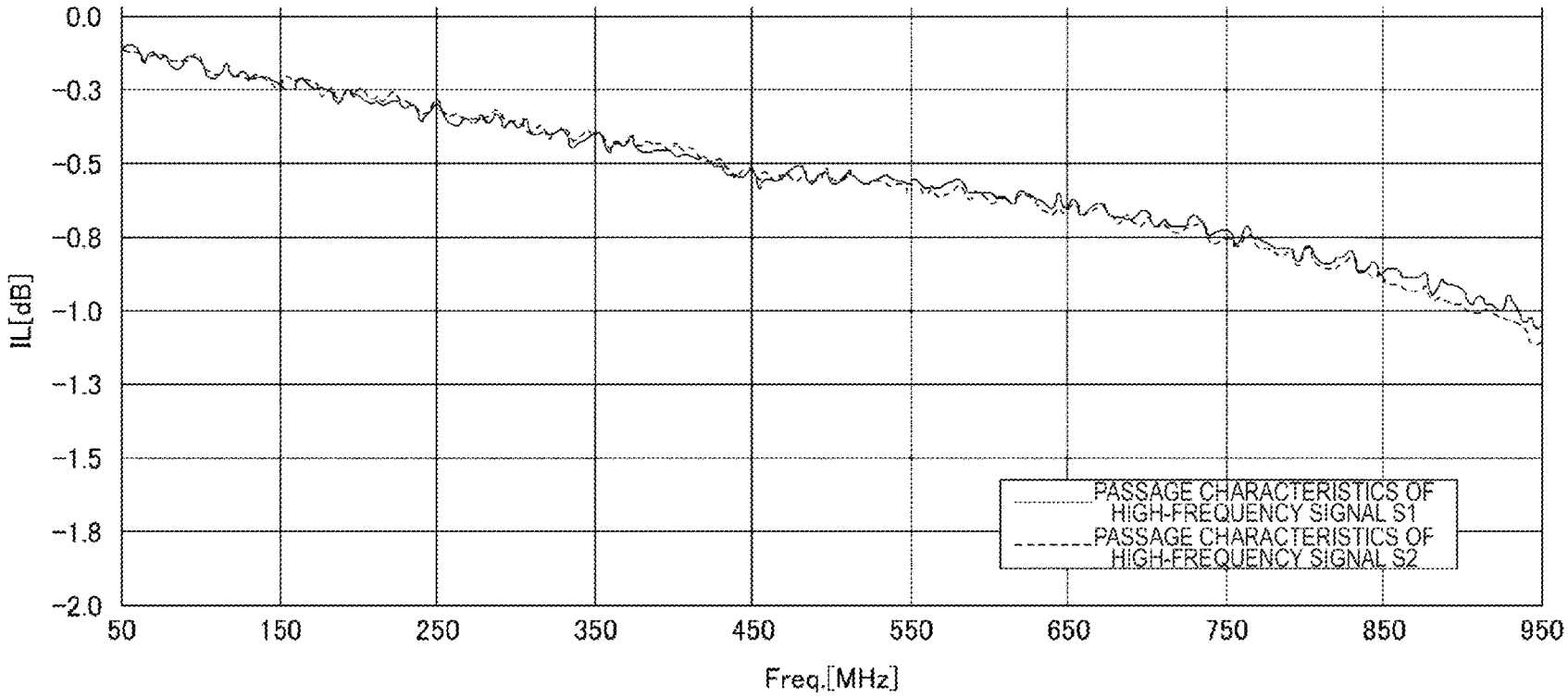
FIG. 6 is a graph illustrating passage characteristics of the first embodiment of the present disclosure.
Figure 7:
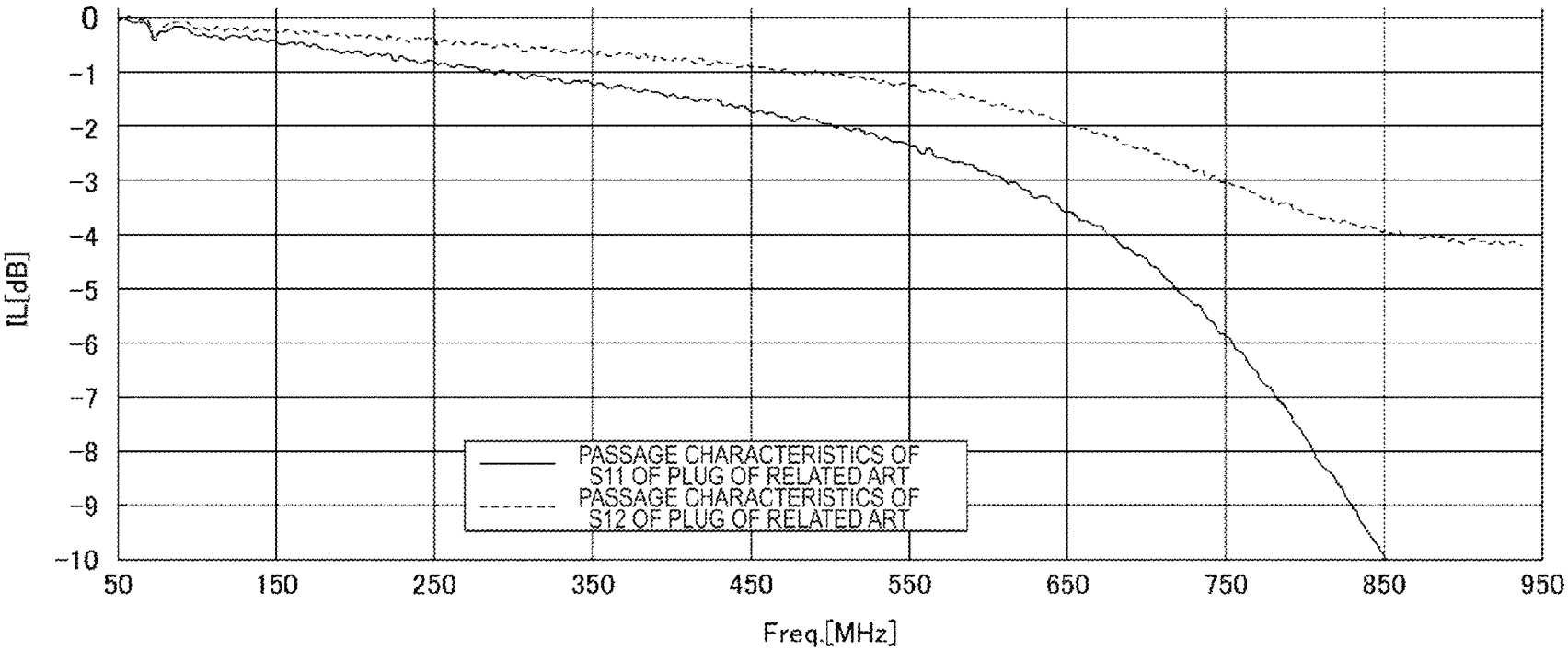
FIG. 7 is a graph illustrating passage characteristics of 4-pole plug of the related art.

Measurement results of passage characteristics of the 4-pole plug according to the first embodiment of the present disclosure are illustrated in FIG. 6. Measurement results of passage characteristics of the 4-pole plug of the related art are illustrated in FIG. 7. As an example, the passage characteristics of a pass band of 50 MHz to 950 MHz were examined. In FIG. 4 described above, one coaxial cable was connected to the connection sections 38*a* and 42*a*, the other coaxial cable was connected to the connection sections 38*b* and 42*b*, a signal for measuring was supplied through each coaxial cable, and the signal obtained from an output of the 4-pole jack 52 was measured. For the 4-pole plug of one embodiment of the present disclosure, the passage characteristics of the high-frequency signal S1 illustrated in FIG. 5 are indicated by a solid line and the passage characteristics of the high-frequency signal S2 are indicated by a dashed line. Attenuations of the high-frequency signals S1 and S2 are small at less than −1 dB.

For the 4-pole plug of the related art illustrated in FIGS. 1A to 1C, the passage characteristics of the high-frequency signal transmission path S11 are indicated by a solid line and the passage characteristics of the high-frequency signal transmission path S12 are indicated by a dashed line. S11 is the high-frequency signal transmission path by the ring 3 and the sleeve 4, and S12 is the high-frequency signal transmission path by the tip 1 and the ring 2. In a case of the 4-pole plug of the related art, as seen from the passage characteristics, particularly, the attenuation of the high-frequency signal transmission path S11 is large and it is difficult to use.

3. Second Embodiment

In the first embodiment of the present disclosure described above, the pin 21, the contact 22, the contact 23, and the contact 24 that protrude from the rear collar 20 of the base section 19 are inserted into the holes 33, 34, and 35 formed in the wiring substrate 31 and are soldered with the conductive pattern on the wiring substrate 31. In other words, the positional relationship is such that the surface of the wiring substrate 31 is substantially orthogonal to the axial direction of the 4-pole plug.

Figure 8:
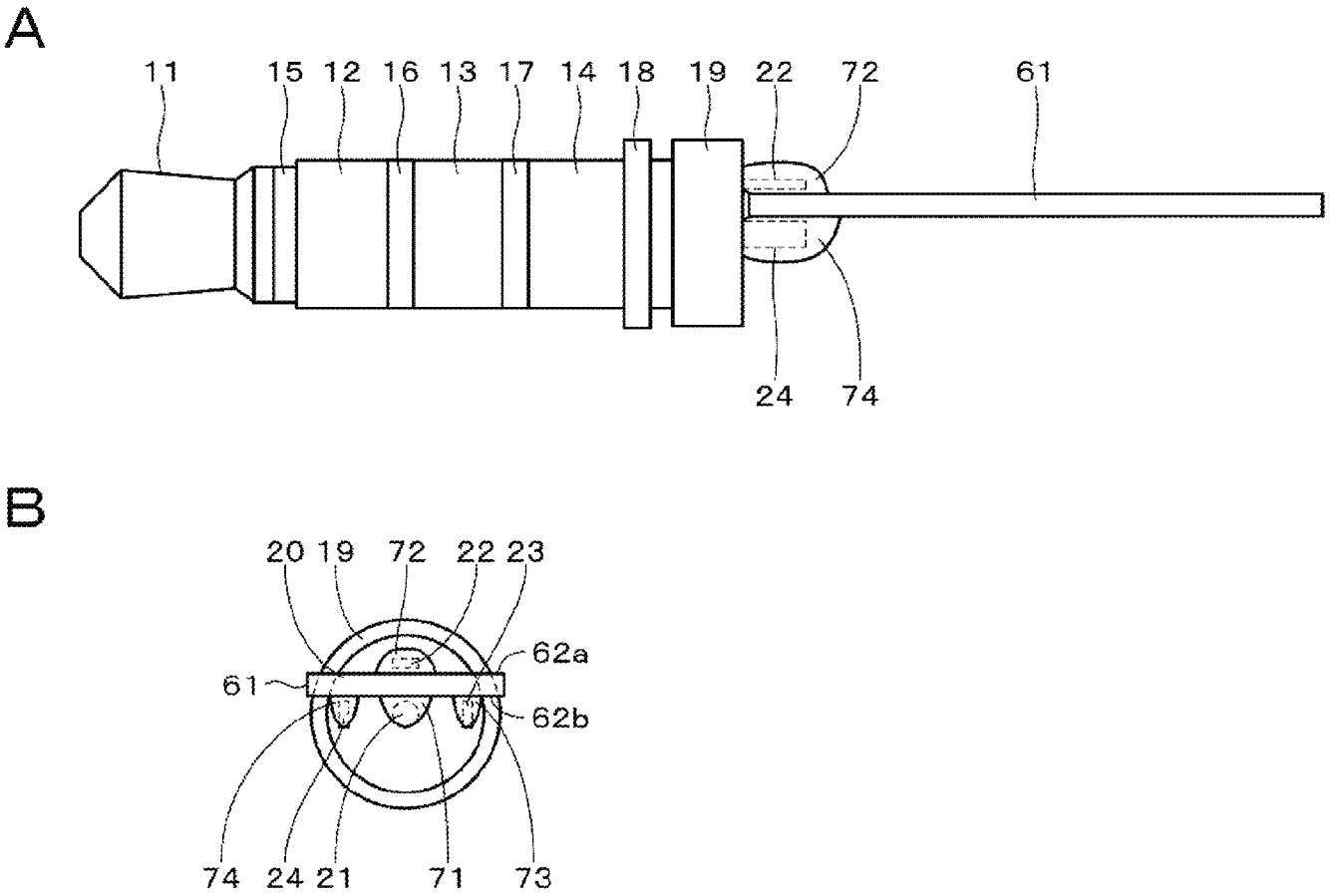
FIG. 8 is an elevational view and a side view of a second embodiment of the present disclosure.

Conversely, in a second embodiment, the positional relationship is such that a surface of a wiring substrate 61 is substantially parallel to the axial direction of the 4-pole plug. FIG. 8 illustrates an elevational view and a side view of the second embodiment of the present disclosure. Similar to the first embodiment described above, the pin 21, the contact 22, the contact 23, and the contact 24 protrude externally outward from the rear collar 20. The pin 21 and the contact 23, and the contact 24 align on the diameter. The pin 21 and the contact 22 align on a radius orthogonal to the above diameter.

Similar to the first embodiment, the pin 21 is electrically connected to the tip 11, the contact 22 is electrically connected to the ring 12, and the contact 23 is electrically connected to the ring 13. In a case in which two high-frequency signal transmission path are formed, one high-frequency signal transmission path is formed by a pair of the pin 21 and the contact 22 (grounding) and another high-frequency signal transmission path is formed by a pair of the contact 23 and the contact 24 (grounding). An antenna is an example of the high-frequency signal transmission path.

In the second embodiment, one end side of the wiring substrate 61 is inserted between the highest upper end of the pin 21, contact 23, and the contact 24 and the lower end of the contact 22, while being kept horizontal. A predetermined portion of the conductive pattern formed on one surface 62*a* of the wiring substrate 61 and the contact 22 are soldered to each other and is fixed to the wiring substrate 61 with solder 72. Furthermore, predetermined portions of the conductive pattern formed on another surface 62*b* of the wiring substrate 61, and the pin 21, the contact 23, and the contact 24 are soldered to each other and are fixed to the wiring substrate 61 with solder 71, 73, and 74. Furthermore, soldering between the pin 21 and the contacts 22, 23, and 24, and the conductive pattern on the wiring substrate 61 can be performed from both surfaces of the wiring substrate 61. Accordingly, soldering is easier to perform. As the substrate of the wiring substrate 61, a rigid substrate such as a glass-epoxy substrate, or a rigid flexible substrate can be used.

Figure 9:
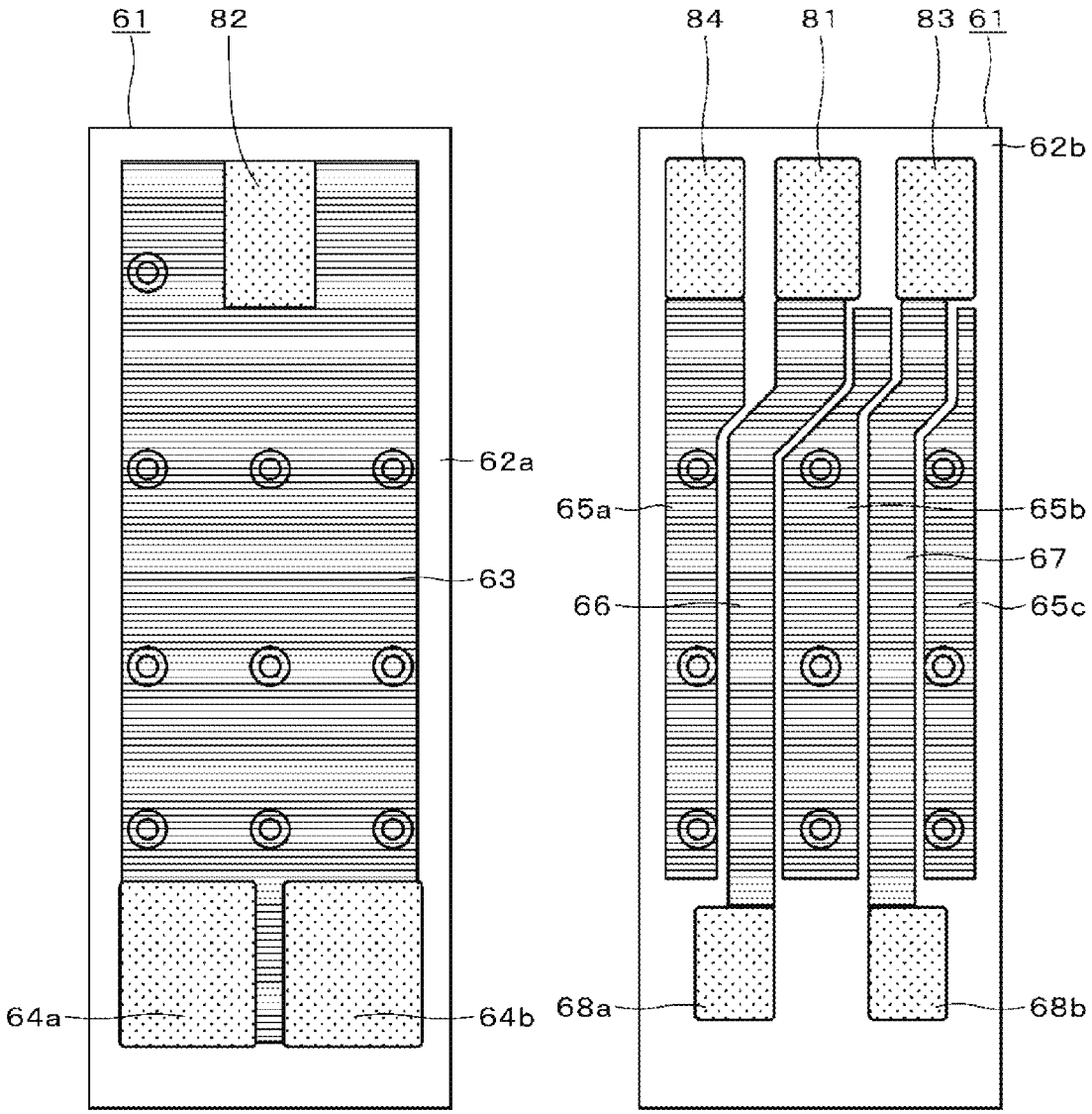
FIG. 9 is a view illustrating both surfaces of a wiring substrate in the second embodiment of the present disclosure.

FIG. 9 illustrates an example of a conducive pattern of the wiring substrate 61. A solder area 82 of the contact 22 and a ground conductive pattern 63 are formed on the one surface 62*a* of the wiring substrate 61. For example, in a case in which two coaxial cables are used as the two high-frequency signal transmission paths, the ground conductive pattern 63 is extended and connection sections 64*a* and 64*b* of the shields of the coaxial cables are provided on the ground conducive pattern 63.

A solder area 84 of the contact 24, a solder area 81 of the pin 21, and a solder area 83 of the contact 23 are formed on the another surface 62*b* of the wiring substrate 61. A ground conductive pattern 65*a* is extended from the solder area 84 of the contact 24. A conductive pattern 66 is extended from the solder area 81 of the pin 21. In a similar manner, a conductive pattern 67 is extended from the solder area 83 of the contact 23. Ground conductive patterns 65*b* and 65*c* are formed parallel to each other. The conductive pattern 65*b* is formed between the conductive patterns 66 and 67. A core wire connection section 68*a* of one coaxial cable is formed at an extension end of the conductive pattern 66, and a core wire connection section 68*b* of another coaxial cable is formed at an extension end of the conductive pattern 67.

In the case of the first embodiment described above, as described with reference to FIG. 5, the 4-pole plug is inserted into the 4-pole jack 52, which conforms to conventional standards, of the electronic device (television tuner, portable device, and the like) 51, and the coaxial cables 43 and 44 are connected to the wiring substrate 31. For example, when the television tuner is configured of a diversity reception system, two antenna signals can be received by just providing a single jack 52.

"Connection Section of Electronic Device"

Figure 10:
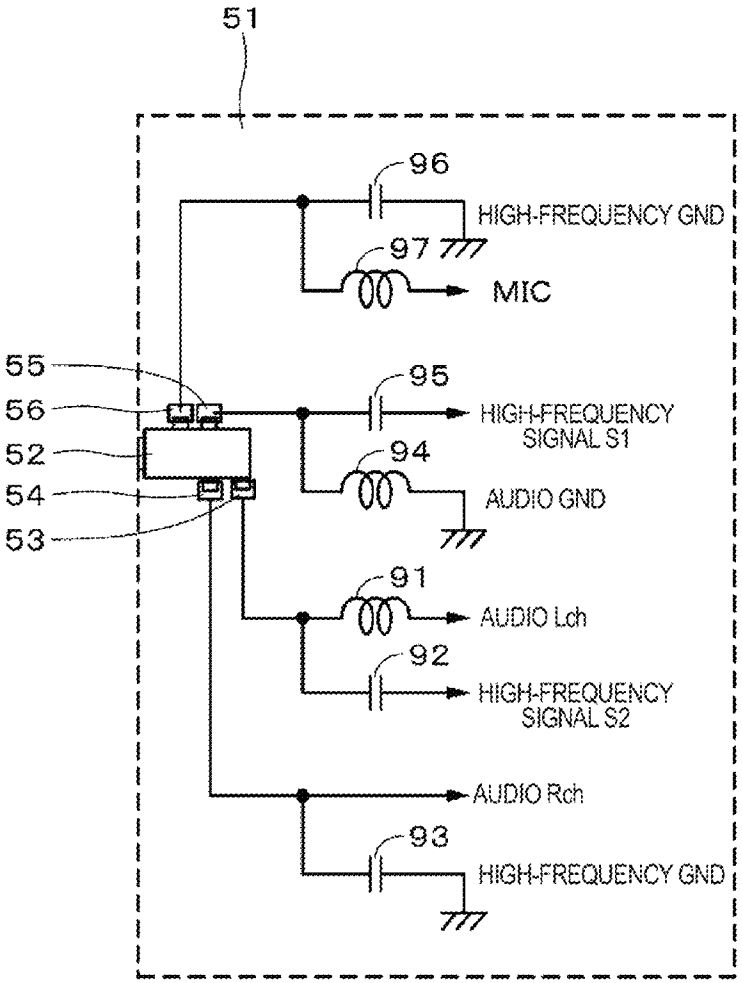
FIG. 10 is a first exemplary circuit diagram of a connection section of the electronic device connected to a second embodiment of the present disclosure.
Figure 10:
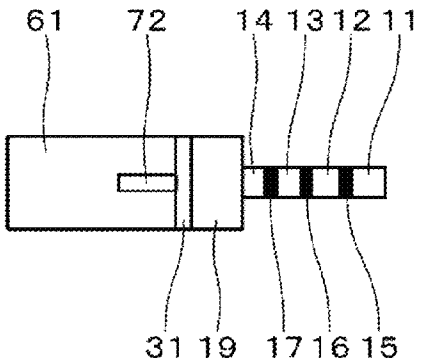

As illustrated in FIGS. 5 and 10, the wiring substrates 31 and 61 are soldered to the connection devices according to the first and second embodiments, respectively, and the connection devices according to the first and second embodiments are each capable of sharing an antenna and an audio transmission cable for an earphone. For example, the two coaxial cables connected to the wiring substrate 61 are connected to the left and right channels of the earphone. In such a case, a jack may be connected to a side of the two coaxial cables to which the wiring substrate 61 is not connected, and a plug of an earphone cable may be connected to the jack to connect the earphone to the earphone cable. The lengths of the two coaxial cable are set so as to correspond to the frequency that is to be received.

As an example, signal assignment is specified in the following manner.

Tip 11: left channel (L)
Ring 12: right channel (R)
Ring 13: grounding
Sleeve 14: microphone Electrodes that come in contact with the electrodes of the 4-pole plug is provided inside the 4-pole jack 52 of the electronic device 51 into which the 4-pole plug is inserted. A ferrite bead 91 and a capacitor 92 are connected in parallel with respect to the connection terminal 53 to which the electrode in contact with the tip 11 is connected. The ferrite bead 91 is a high-frequency attenuation element that has a high impedance at the required frequency and that has a low resistance value at the audio frequency band. A coil may be used in place of the ferrite bead. The audio signal (L channel) is supplied through the ferrite bead 91, and the high-frequency signal S2 is output through the capacitor 92.

The connection terminal 54 that is connected to the electrode in contact with the ring 12 is grounded through the capacitor 93 in a high-frequency manner such that grounding of the high-frequency signal S2 is performed. The audio signal (R channel) is supplied from between the connection terminal 54 and the capacitor 93.

The connection terminal 55 connected to the electrode in contact with the ring 13 is grounded (grounding for the audio signal) through a coil 94 and is connected to a capacitor 95. The high-frequency signal S1 is extracted through the capacitor 95. Grounding of the audio signal between the left and right channels is performed in a common manner.

The connection terminal 56 that is connected to the electrode in contact with the sleeve 14 is grounded through a capacitor 96 in a high-frequency manner and a microphone signal is extracted from the connection terminal 56 through a ferrite bead 97. For example, when the television tuner is configured of a diversity reception system, audio signals of the left and right channels can be transmitted to the earphone and two antenna signals S1 and S2 can be received by providing just a single jack 52.

Figure 11:
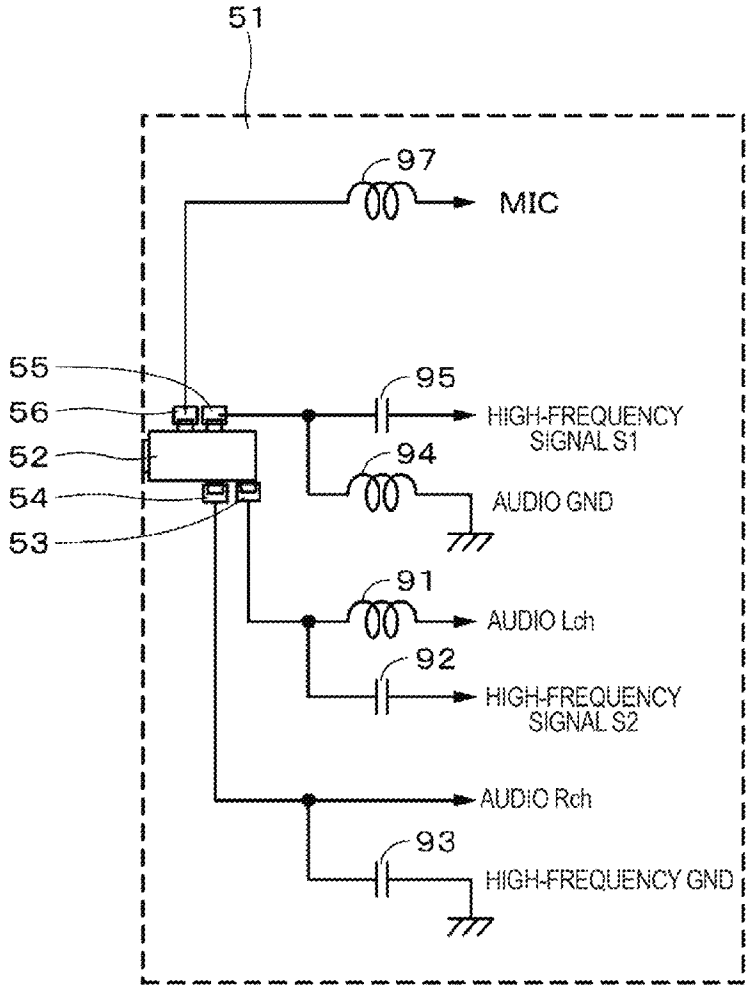
FIG. 11 is a second exemplary circuit diagram of a connection section of the electronic device connected to a second embodiment of the present disclosure.
Figure 11:
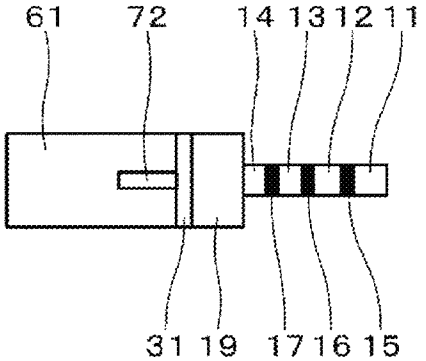

FIG. 11 illustrates a second exemplary configuration of the connection section of the electronic device 51. In the second exemplary configuration, in a case in which the antenna cable is a monopole antenna, the capacitor 96 in the configuration of FIG. 10 is omitted.

Figure 12:
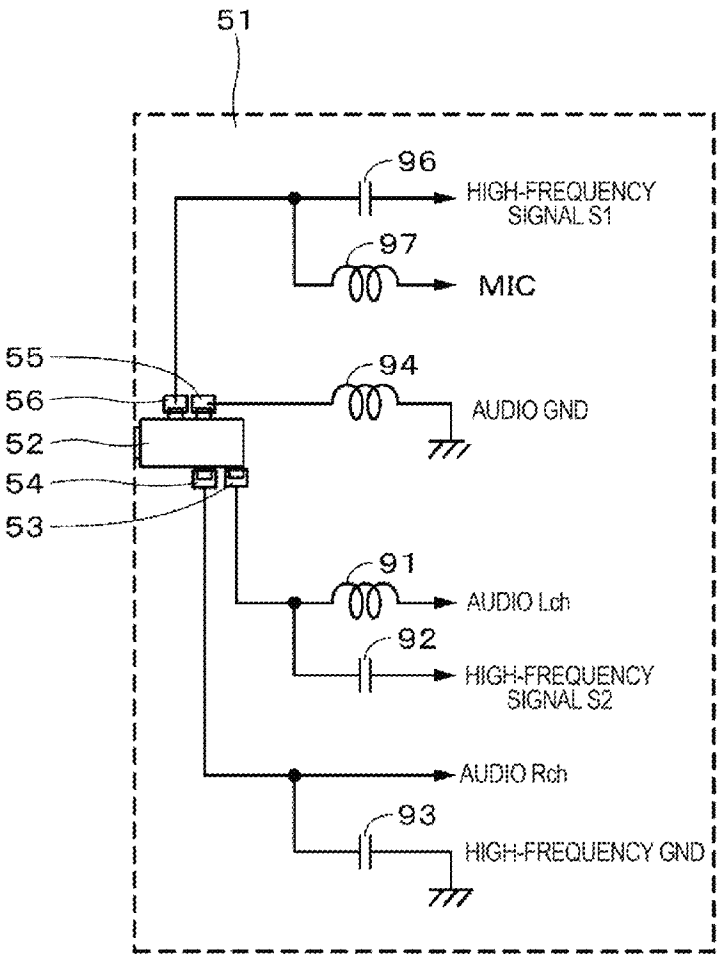
FIG. 12 is a third exemplary circuit diagram of a connection section of the electronic device connected to a second embodiment of the present disclosure.
Figure 12:
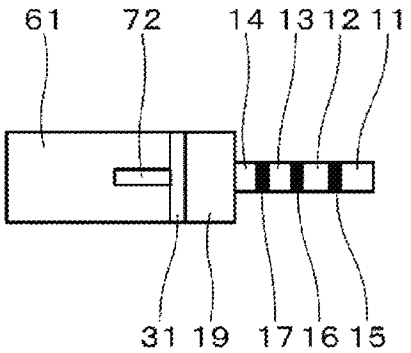

FIG. 12 illustrates a case in which the antenna cable is a monopole antenna and a third exemplary configuration of the connection section of the electronic device 51 connected to the connection terminal 56. As illustrated in FIG. 12, the connection terminal 55 is grounded (grounding for the audio signal) through a ferrite bead 94, and the capacitor 96 and the ferrite bead 97 are connected in parallel with each other with respect to the connection terminal 56. Then, the high-frequency signal S1 is extracted through the capacitor 96 and the microphone signal is extracted through the ferrite bead 97.

4. Modification Examples

The foregoing has described in detail the embodiments of the present disclosure, but it is not intended to be limited to each embodiment described above and various modifications may be performed based on the technical concept of the present disclosure. For example, the configurations, the methods, the processes, the shapes, the materials, the numerical values, and the like mentioned in the above embodiments are merely examples, and a configuration, a method, a process, a shape, a material, a numerical value, and the like different therefrom may be used if necessary. For example, in the first embodiment, the 4-pole plug is exemplified, but the present disclosure may be applied to 5 or more-pole plug. Furthermore, the present disclosure may be applied to a case where the high-frequency signal is output in addition to the input of the high-frequency signal.

Additionally, the present technology may also be configured as below.

(1) A connection device, including:
- a rod-shaped electrode;
- a plurality of cylindrical electrodes through which the rod-shaped electrode passes, the plurality of cylindrical electrodes being sequentially exposed on a surface in order from a front end side of the rod-shaped electrode;
- an insulation section configured to insulate the rod-shaped electrode and the plurality of cylindrical electrodes from each other; and
- a plurality of connection terminals electrically connected to the rod-shaped electrode and the plurality of cylindrical electrodes in a vicinity of a rear end of the rod-shaped electrode, the plurality of connection terminals being protruded from a rear side.

(2) The connection device according to (1),
- wherein three or more cylindrical electrodes are provided, and
- wherein four or more connection terminals that are electrically connected to the rod-shaped electrode and the cylindrical electrodes are led out.

(3) The connection device according to (1),
- wherein the connection terminals are connected to a conductor pattern on a wiring substrate and establishes a connection with an external unit through the wiring substrate.

(4) The connection device according to (3),
- wherein the wiring substrate is either one of a rigid substrate, a flexible substrate, and a rigid flexible substrate.

(5) The connection device according to (3),
wherein a cable configured to function as an antenna is connected through the wiring substrate.

(6) The connection device according to (3),
wherein a cable configured to function as an antenna and an audio signal transmission cable are connected through the wiring substrate.

(7) The connection device according to (3),
wherein the connection terminals are each inserted into a hole formed in the wiring substrate.

(8) The connection device according to (1),
wherein the plurality of cylindrical electrodes are led out as the connection terminals through extension electrodes, and
wherein intervals between the extension electrodes are substantially equal to each other in a cross-sectional direction.

(9) The connection device according to (1),
wherein a first pair of the rod-shaped electrode and one of the cylindrical electrodes adjacent to the rod-shaped electrode, and a second pair of two cylindrical electrodes form two high-frequency signal transmission paths.

(10) The connection device according to (9),
wherein the connection terminals are connected to a conductor pattern on a wiring substrate, and two coaxial wires corresponding to the two high-frequency signal transmission paths are connected to the conductor pattern.

(11) A reception device to which a connection device is capable of being connected,
wherein the connection device includes
a rod-shaped electrode,
a plurality of cylindrical electrodes through which the rod-shaped electrode passes, the plurality of cylindrical electrodes being sequentially exposed on a surface in order from a front end side of the rod-shaped electrode,
an insulation section configured to insulate the rod-shaped electrode and the plurality of cylindrical electrodes from each other, and
a plurality of connection terminals electrically connected to the rod-shaped electrode and the plurality of cylindrical electrodes in a vicinity of a rear end of the rod-shaped electrode, the plurality of connection terminals being protruded from a rear side.

(12) The reception device according to (11),
wherein first and second high-frequency signals are obtained from two terminals among the plurality of connection terminals through capacitors.

(13) The reception device according to (11),
wherein two terminals among the plurality of connection terminals are connected to a high-frequency attenuation element and the two terminals are configured as first and second audio signal terminals.

REFERENCE SIGNS LIST

11 tip
12 ring
13 ring
14 sleeve
19 base section
20 rear collar
21 pin
22, 23, 24 contact
25, 26 extension electrode
31, 61 wiring substrate
33, 34, 35, 36 hole
52 4-pole plug

The invention claimed is:

1. A connection device, comprising:
a rod-shaped electrode;
a plurality of cylindrical electrodes through which the rod-shaped electrode passes, the plurality of cylindrical electrodes being sequentially exposed on a surface in order from a front end side of the rod-shaped electrode;
an insulation section configured to insulate the rod-shaped electrode and the plurality of cylindrical electrodes from each other; and
a plurality of connection terminals electrically connected to the rod-shaped electrode and the plurality of cylindrical electrodes in a vicinity of a rear end of the rod-shaped electrode, the plurality of connection terminals being protruded from a rear side, wherein the connection terminals are connected to a conductor pattern on a wiring substrate and establish a connection with an external unit through the wiring substrate, and wherein the wiring substrate is located at the rear end of the rod-shaped electrode.

2. The connection device according to claim 1,
wherein three or more cylindrical electrodes are provided, and
wherein four or more connection terminals that are electrically connected to the rod-shaped electrode and the cylindrical electrodes are led out.

3. The connection device according to claim 1
wherein the wiring substrate is either one of a rigid substrate, a flexible substrate, and a rigid flexible substrate.

4. The connection device according to claim 1
wherein a cable configured to function as an antenna is connected through the wiring substrate.

5. The connection device according to claim 1
wherein a cable configured to function as an antenna and an audio signal transmission cable are connected through the wiring substrate.

6. The connection device according to claim 1
wherein the connection terminals are each inserted into a hole formed in the wiring substrate.

7. The connection device according to claim 1,
wherein the plurality of cylindrical electrodes are led out as the connection terminals through extension electrodes, and
wherein intervals between the extension electrodes are substantially equal to each other in a cross-sectional direction.

8. The connection device according to claim 1,
wherein a first pair of the rod-shaped electrode and one of the cylindrical electrodes adjacent to the rod-shaped electrode, and a second pair of two cylindrical electrodes form two high-frequency signal transmission paths.

9. The connection device according to claim 8,
wherein the connection terminals are connected to a conductor pattern on a wiring substrate, and two coaxial wires corresponding to the two high-frequency signal transmission paths are connected to the conductor pattern.

10. A reception device to which a connection device is capable of being connected,
wherein the connection device includes
a rod-shaped electrode,
a plurality of cylindrical electrodes through which the rod-shaped electrode passes, the plurality of cylindrical electrodes being sequentially exposed on a surface in order from a front end side of the rod-shaped electrode, an insulation section configured to insulate the rod-shaped electrode and the plurality of cylindrical electrodes from each other, and a plurality of connection terminals electrically connected to the rod-shaped electrode and the plurality of cylindrical electrodes in a vicinity of a rear end of the rod-shaped electrode, the plurality of connection terminals being protruded from a rear side, wherein the connection terminals are connected to a conductor pattern on a wiring substrate and establish a connection with an external unit through the wiring substrate, and wherein the wiring substrate is located at the rear end of the rod-shaped electrode.

11. The reception device according to claim 10, wherein first and second high-frequency signals are obtained from two terminals among the plurality of connection terminals through capacitors.

12. The reception device according to claim 10, wherein two terminals among the plurality of connection terminals are connected to a high-frequency attenuation element and the two terminals are configured as first and second audio signal terminals.

* * * * *